United States Patent [19]

Parsons

[11] Patent Number: 5,032,069

[45] Date of Patent: Jul. 16, 1991

[54] ROTARY POSITION DISPLACEMENT PUMP OR MOTOR

[75] Inventor: Bryan N. V. Parsons, Stoney Stanton, United Kingdom

[73] Assignee: Jaguar Cars Limited, United Kingdom

[21] Appl. No.: 378,024

[22] Filed: Jul. 11, 1989

[30] Foreign Application Priority Data

Jul. 20, 1988 [GB] United Kingdom ..... 8817284

[51] Int. Cl.[5] ..... F01C 2/10; F04C 2/10

[52] U.S. Cl. ..... 418/71; 418/159; 418/170

[58] Field of Search ..... 418/169, 170, 159, 71, 418/126, 129

[56] References Cited

U.S. PATENT DOCUMENTS

| | | | |
|---|---|---|---|
| 1,769,047 | 7/1930 | Weeden . | |
| 3,406,631 | 7/1966 | Brown | 418/170 |
| 3,679,334 | 7/1972 | Keldrauk | 418/170 |
| 4,392,799 | 7/1983 | Shikamo | 418/126 |

FOREIGN PATENT DOCUMENTS

| | | | |
|---|---|---|---|
| 1293024 | 9/1958 | Fed. Rep. of Germany . | |
| 2943768 | 10/1979 | Fed. Rep. of Germany . | |
| 3047609 | 12/1980 | Fed. Rep. of Germany . | |
| 977510 | 7/1942 | France . | |
| 55877 | 11/1943 | France | 418/169 |
| 2101659 | 3/1972 | France . | |
| 2329872 | 10/1976 | France . | |
| 211711 | 10/1939 | Switzerland | 418/71 |
| 1414430 | 11/1975 | United Kingdom | 418/170 |

*Primary Examiner*—Leonard E. Smith
*Assistant Examiner*—D. L. Cavanaugh
*Attorney, Agent, or Firm*—Davis, Bujold & Streck

[57] ABSTRACT

A hydraulic device has an inner rotor of cylindrical section mounted eccentrically within an outer rotor of tubular section. Angularly spaced axially extending ribs of part-circular cross-section are provided on the inner rotor and correspondingly spaced axial recesses of part-circular cross-section are provided on the opposed surface of the outer rotor, the ribs meshing with the recesses over an arcuate working zone in which a plurality of adjacent ribs engage corresponding recesses, the ribs moving relative to but in engagement with the recesses as they progress through the working zone. A baffle is located between the rotors to provide a seal therebetween outside the working zone and an inlet port is provided to the working zone adjacent the termination thereof relative to the direction of rotation of the rotors while an outlet port is provided adjacent the center of the working zone, the inlet and outlet ports being separated by at least the pitch of the ribs on the rotor.

14 Claims, 3 Drawing Sheets

ROTARY POSITION DISPLACEMENT PUMP OR MOTOR

BACKGROUND OF THE INVENTION

The present invention relates to hydraulic devices and in particular to hydraulic motors or pumps.

SUMMARY OF THE INVENTION

According to one aspect of the present invention a hydraulic device comprises an inner rotor of cylindrical section and outer rotor of tubular section, the inner rotor being mounted eccentrically of the outer rotor, angularly spaced axially extending ribs of part-circular cross-section being provided on one of the opposed surfaces of the rotors and corresponding spaced axial recesses of part-circular cross-section on the other surface, the radius of the recesses being equal to the sum of the radius of the ribs plus the eccentricity of the rotors and the difference between the radius of the peaks of the ribs and the troughs of the recesses being equal to the eccentricity, so that the ribs on one rotor will mesh with the recesses of the other rotor over an arcuate working zone, a plurality of adjacent ribs engaging corresponding recesses in said working zone and said ribs moving in engagement with the recesses as they progress through the working zone; a baffle being located between the rotors to provide a seal therebetween outside the working zone, an inlet port opening into the working zone adjacent the termination thereof relative to the direction of rotation of the rotors and an outlet port adjacent the centre of the working zone, the inlet and outlet ports being separated by at least the pitch of the ribs on the one rotor in a part of the working zone in which the ribs engage the recesses.

In accordance with the present invention, when the device operates as a pump, one of the rotors is driven, the drive being transmitted to the other rotor by meshing of the ribs and recesses. Hydraulic fluid is introduced into the space between the rotors through the inlet port and moves around until the beginning of the working zone, when penetration of the ribs into the recesses will reduce the volume therebetween, thus expelling hydraulic fluid through the outlet port. Conversely, if hydraulic fluid under pressure is introduced into the working zone through the inlet port, the pressure of fluid will drive the rotors and the device to function as a motor.

The baffle which provides a seal between the rotors outside the working zone is preferably crescent shaped and provides a seal adjacent both ends of the working zone. This baffle may conveniently be formed in two parts and preferably these parts are urged apart by resilient means towards each end of the working zone, so that the baffles are able to accommodate wear. Alternatively, a one or two part baffle may be fixed formed, for example, as an integral part of an end plate which closes the gap between the rotors.

Preferably, the inlet and outlet ports are arcuate and extend over several times the pitch of the ribs on the one rotor. In a preferred embodiment, the inlet and/or outlet ports are adjustable angularly of the working zone, to adjust the pumping rate or speed of the device.

BRIEF DESCRIPTION OF THE DRAWINGS

The invention is now described, by way of example only, with reference to the accompanying drawings, in which.

DESCRIPTION OF A PREFERRED EMBODIMENT

Figure 1:
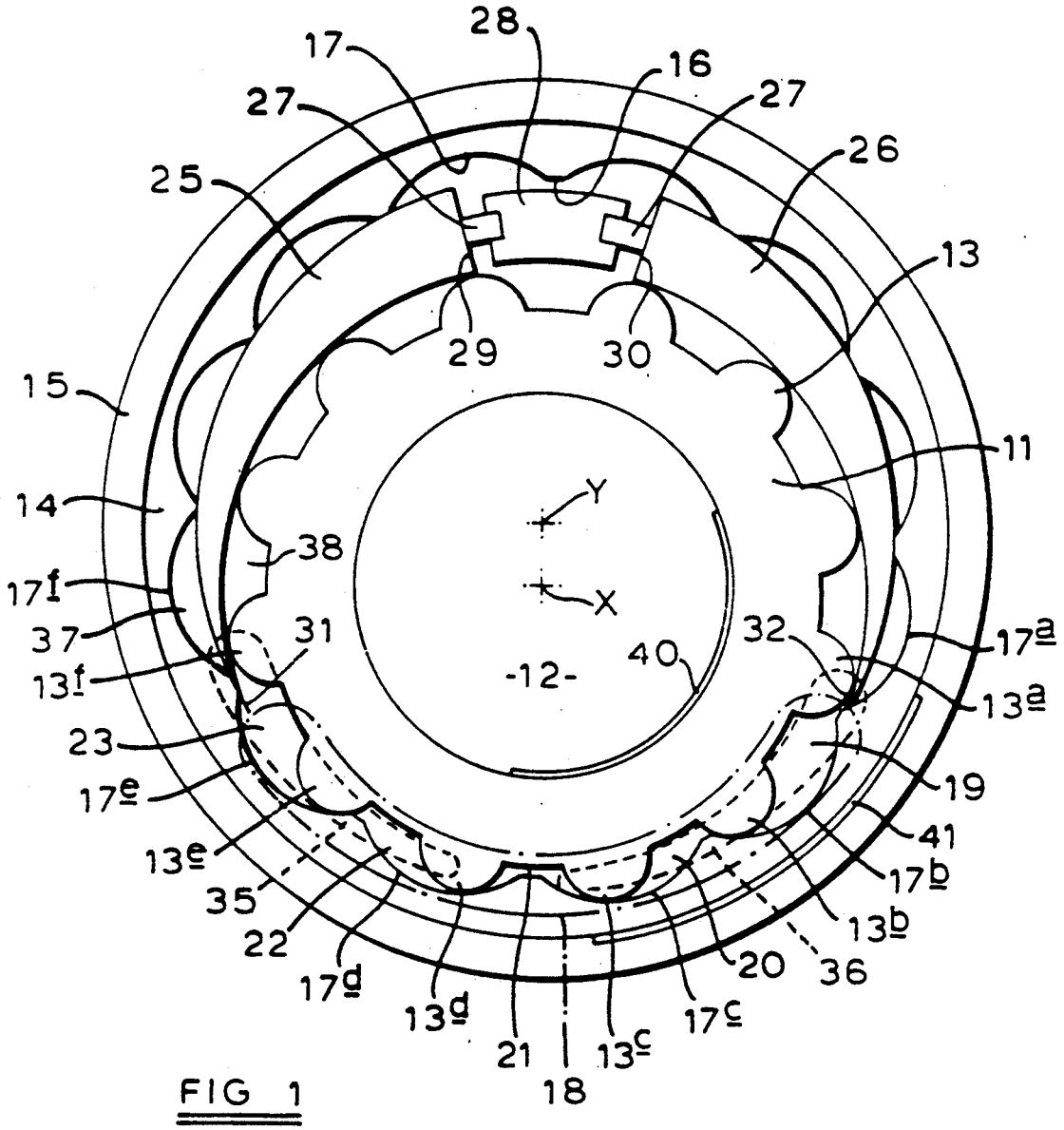
FIG. 1 illustrates an hydraulic pump in accordance with the present invention.
Figure 2:
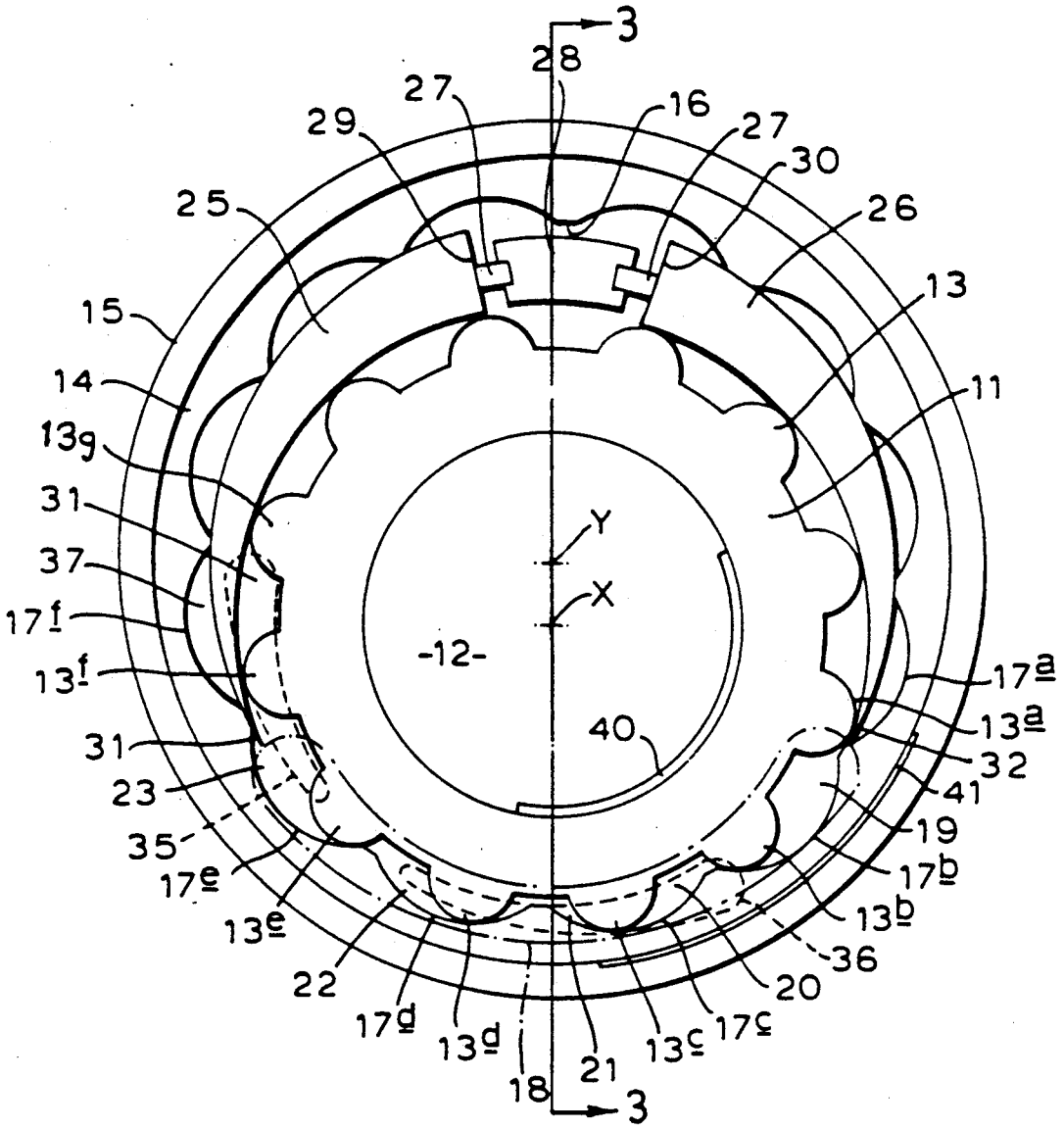
FIG. 2 illustrates the pump shown in FIG. 1 with the inlet and outlet ports adjusted.
Figure 3:
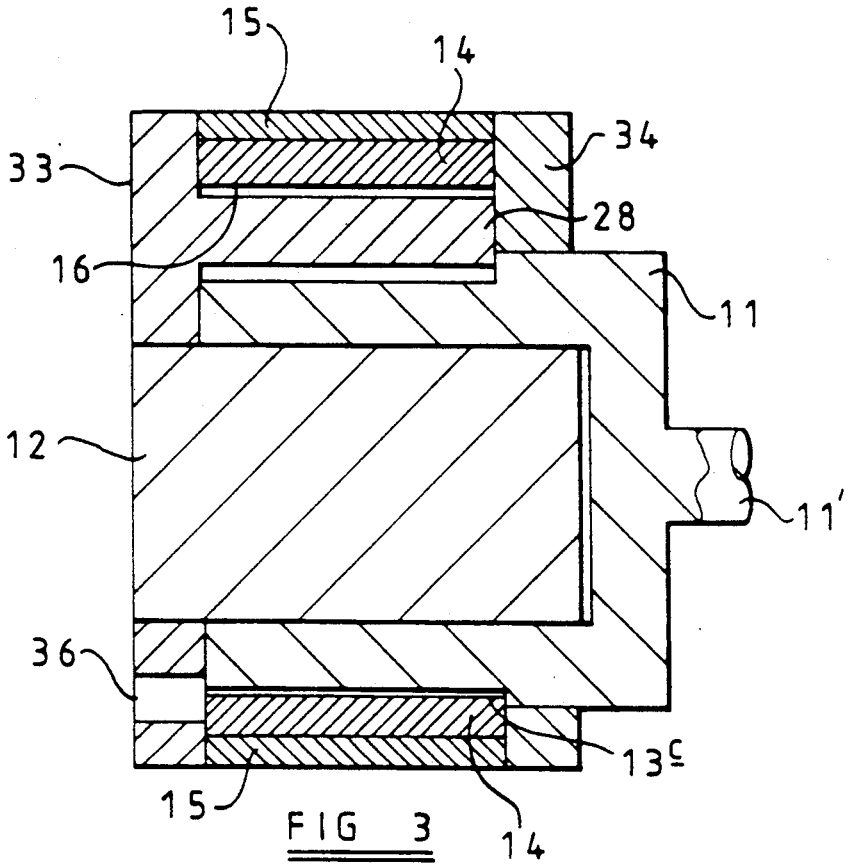
FIG. 3 is a section along the line 3—3 in FIG. 2.

The pump illustrated in FIGS. 1 and 2 comprises a first rotor 11 mounted on a bearing 12 for rotation by a drive shaft 11' about axis X. The rotor 11 is of cylindrical configuration, having a series of angularly spaced semi-circular axial ribs 13.

The rotor 11 is mounted within a tubular rotor 14 which is mounted in bearing 15 for rotation about an axis Y which is parallel to axis X but spaced radially therefrom. Inner cylindrical surface 16 of rotor 14 is provided with a series of axial recesses 17 of part-circular section, each of these recesses 17 corresponding to one of the ribs 13 on the rotor 11. The radius of each of the recesses 17 is equal to the radius of the ribs 13 plus the separation of the axes X and Y; and the radius of the peaks of the ribs 13 and troughs of the recesses 17 is such that the ribs 13 will move into mesh with the recesses 17 over a working zone 18 (shown in broken line in FIG. 1). In the working zone 18, several of the ribs, 13*b*, 13*c*, 13*d* and 13*e* engage the corresponding recesses 17*b*, 17*c*, 17*d* and 17*e* to define chambers 19, 20, 21, 22 and 23. As the rotors 11 and 14 rotate, the ribs 13 as they progress through the working zone 18 will initially engage the leading edge of the associated recess 17, as illustrated with rib 13*b* and recess 17*b* in FIG. 1. The rib 13 will then slide backwardly relative to the recess 17 over the surface thereof, until towards the end of the working zone 18, the rib 13 will engage the trailing end of the recess 17 as illustrated with rib 13*e* and recess 17*e* in FIG. 1.

Figure 4:
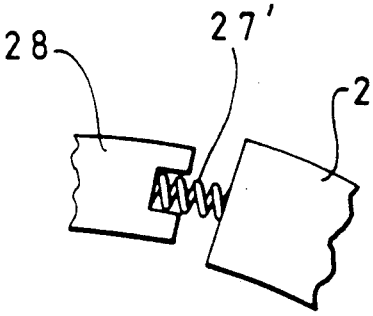
FIG. 4 illustrates a modification to the pump illustrated in FIG. 1.

A pair of crescent shaped baffles 25 and 26 are located in the gap between rotors 11 and 14, in the region in which the ribs 13 and recess 17 do not mesh. The baffles 25 and 26 are forced apart by resilient means 27 which act between the fixed support 28 and the ends 29 and 30 of the baffles 25 and 26 to force the pointed ends 31 and 32 thereof, towards the positions at which the ribs 13 and recesses 17 begin and cease to mesh respectively, thereby defining the working zone 18. The resilient means 27 may, for example, be spring means, for example one or more helically wound compression springs 27' as illustrated in FIG. 4 or leaf springs or blocks of resilient material 27 as illustrated in FIG. 1 which extend longitudinally of the rotors 11 and 14. Alternatively the baffles 25 and 26 may be loaded towards the working zone 18 by hydraulic means.

A pair of end plates 33 and 33 are provided across the ends of rotors 11 and 14 and make sealing engagement therewith, to close the gap between the rotors 11 and 14. The support 28 is secured to one of these end plates.

An arcuate inlet port 35 and outlet port 36 (illustrated in broken line) are provided in the other end plate. Inlet port 35 is positioned adjacent and overlaps the termination of working zone 18, while the outlet port 36 is positioned adjacent and overlaps the beginning of the working zone 18. Inlet and exhaust ports 35 and 36 are separated from one another by at least the pitch of the ribs 13 on rotor 11 and each extends over an arc of several pitches of the ribs 13.

In operation, hydraulic fluid is introduced through inlet port 35 into chambers 22 and 23 and also into chambers 37 and 38 defined by recess 17*f* and baffle 25 and ribs 13*f* and 13*g* and baffle 26 respectively. While chambers 22 and 23 are increasing in volume as they approach the termination of the working zone 18, overlapping of the chambers 37 and 38 which are of constant volume will ensure that the fluid in these constant volume chambers will be at the supply pressure.

Rotation of the rotors 11 and 14 will then move fluid around the non-meshing part of the pump at constant pressure, until it reaches the beginning of the working zone 18.

As the fluid enters the working zone 18 and rib 13*b* begins to enter the recess 17*b*, fluid will be displaced from the fluid tight chamber 19 defined by ribs 13*a*, 13*b*, the baffle 25 and recesses 17*a* and 17*b*, out through the outlet port 36. Progressing through the working zone 18, the fluid tight chambers 20 and 21 are progressively reduced in volume displacing further fluid through the outlet port 36, until the land between successive recesses is located midway between two ribs, as indicated in FIG. 1 in chamber 21, where the volume will be at a minimum.

The net pumping rate achieved in this manner will consequently correspond to the reduction in volume from the combined chambers 37 and 38 to chamber 21.

As illustrated in FIG. 2, the pumping rate may be reduced by rotating the end plate which defines the inlet and outlet ports 35 and 36, so that the outlet port 36 overlies chamber 22 which is increasing in volume and will draw fluid back from the outlet port 36.

A pair of hydrostatic balance pressure pads 40 and 41 may be provided on bearings 12 and 15 respectively, these pressure pads 40 and 41 being angularly aligned with the high pressure region of the working zone 18 in order to oppose the loads applied to rotors 11 and 14 by the pressure in that region. Fluid under pressure may be bled to the pressure pads 40 and 41 directly from the working zone 18 or from the outlet port 36.

The pump described above may alternatively be operated as a motor. In this case hydraulic fluid under pressure is introduced through port 35. Because of the eccentricity of rotors 11 and 14, the surface areas of chamber 22 defined by rib 13*e* and recess 17*d* will be greater than that defined by rib 13*a* and recess 17*d* and similarly the surface area of chamber 23 defined by rib 13*f* and recess 17*e* will be greater than that defined by rib 13*e* and recess 17*e*.

Consequently the pressure of fluid in chambers 22 and 23 will generate a force on the rotors 11 and 14 rotating them in the clockwise direction.

As the rotors 11 and 14 rotate, the volumes of chambers 22 and 23 increase until they are of the same volume as the combined chambers 37 and 38. The fluid will be carried round with the rotors 11 and 14 and expelled, at reduced pressure, through port 36.

In similar manner, if hydraulic fluid under pressure is introduced through port 36, the pressure of fluid in chambers 19 and 20 will drive the rotors 11 and 14 anticlockwise, thus reversing the drive.

When used as a motor, the rotor 11 may, for example, be defined by the hub of a wheel bearing 15 forming part of a stationary hub carrier.

Various modifications may be made without departing from the invention. For example while in the above embodiment ribs 13 are provided on the inner rotor 11 and recesses 17 on the outer rotor 14, the ribs 13 may be provided on the inner surface of outer rotor 14 and recesses 17 on the inner rotor 11. Also while in the above embodiment the ports 35 and 36 are provided on one end plate, one port may be provided on each of the end plates so that they are independently adjustable. While it is advantageous to have adjustable ports, fixed ports may alternatively be used.

I claim:

1. A hydraulic device comprising an inner rotor of cylindrical section, an outer rotor of tubular section mounted eccentrically of the inner rotor, one of the opposed cylindrical surfaces of the rotor having angularly spaced axially extending ribs of part-circular cross-section, the other cylindrical surface having correspondingly spaced axial recesses of part-circular cross section, the radius of the recesses being equal to the sum of the radius of the ribs plus the eccentricity of the rotors and the difference between the radius of the peaks of the ribs and the troughs of the recesses being equal to the eccentricity, the ribs on one rotor meshing with the recesses of the other rotor over an arcuate working zone, a plurality of adjacent ribs engaging corresponding recesses in said working zone and said ribs moving in engagement with the recesses as they progress through the working zone; a baffle located between the rotors to provide a seal therebetween outside the working zone, an inlet port opening into the working zone adjacent the termination thereof relative to the direction of rotation of the rotors and an outlet port adjacent of the center of the working zone, the inlet and outlet ports being separated by at least the pitch of the ribs on the one rotor in a part of the working zone in which the ribs engage the recesses.

2. A hydraulic device according to claim 1 in which end plates are provided abutting each end of each of the rotors to close the gap therebetween.

3. A hydraulic device according to claim 1 in which the baffle is of crescent shape and provides a seal with each of the rotors, adjacent each end of the working zone.

4. A hydraulic device according to claim 3 in which the baffle is formed from two parts, each part being resiliently urged towards one end of the working zone.

5. A hydraulic device according to claim 4 in which resilient means acts between a fixed support and the end of each part of the baffle remote from the working zone.

6. A hydraulic device according to claim 5 in which a fixed support is provided on one of the end plates.

7. A hydraulic device according to claim 1 in which the baffle is fixed.

8. A hydraulic device to claim 1 in which the inlet and outlet ports are arcuate and extend over several times the pitch of the ribs on said one rotor.

9. A hydraulic device according to claim 8 in which the inlet and outlet ports are adjustable angularly of the working zone.

10. A hydraulic device according to claim 9 in which the inlet and outlet ports are adjustable angularly by rotation of one or both end plates.

11. A hydraulic pump comprising a hydraulic device as claimed in claim 1, in which the inner rotor is mounted on suitable bearing means, for rotation by a drive shaft and the outer rotor is mounted in a suitable bearing, the inlet port being adapted to be connected to a source of hydraulic fluid and the outlet port being adapted to be connected to a delivery line.

12. A hydraulic pump according to claim 11 in which hydrostatic balance pressure pads are provided on the inner and outer rotor bearing means, said pressure pads being angularly aligned with the region of the working zone covered by the outlet port.

13. A hydraulic motor comprising a device as claimed in claim 1 in which the inlet and outlet ports are adapted to be selectively connected to a source of pressure fluid or to a drain.

14. A hydraulic motor according to claim 13 in which the inner rotor is defined by a wheel hub and the outer rotor is mounted in a bearing forming part of a stationary hub carrier.

* * * * *